United States Patent [19]

Arauchi

[11] Patent Number: 4,772,140

[45] Date of Patent: Sep. 20, 1988

[54] PRINT HEAD DRIVE SYSTEM WITH TROUBLE DETECTOR

[75] Inventor: Susumu Arauchi, Iwate, Japan

[73] Assignee: Alps Electric Co., Ltd., Japan

[21] Appl. No.: 893,784

[22] Filed: Aug. 6, 1986

[30] Foreign Application Priority Data

Aug. 6, 1985 [JP] Japan ..... 60-172963

[51] Int. Cl.[4] ..... B41J 29/38

[52] U.S. Cl. ..... 400/54; 400/120; 400/121; 400/74

[58] Field of Search ..... 400/54, 74, 120, 121, 400/124; 101/93.29

[56] References Cited

FOREIGN PATENT DOCUMENTS

| | | | |
|---|---|---|---|
| 101878 | 8/1981 | Japan | 400/74 |
| 91277 | 6/1982 | Japan | 400/54 |
| 166083 | 10/1983 | Japan | 400/74 |
| 16773 | 1/1984 | Japan | 400/54 |
| 48175 | 3/1984 | Japan | 400/54 |
| 139461 | 7/1985 | Japan | 400/74 |

*Primary Examiner*—David Wiecking
*Attorney, Agent, or Firm*—Guy W. Shoup; Paul J. Winters; Gerard F. Dunne

[57] ABSTRACT

A print head drive system of the type wherein there is provided a one-shot generating circuit for generating one-shot pulses in response to an instruction given from a processor and the energization of a head is effected in response to the one-shot pulse supplied from the one-shot generating circuit, characterized in that there is included a mechanical trouble detector for detecting occurrence of trouble, the pulse duration of one-shot pulse generated in the one-shot generating circuit is made shorter than the time interval during which the energization of the head is effected in the normal operating time, and the processor issues during the normal operating time the instruction plural times to the one-shot generating circuit, whereby when abnormal operation is detected by the mechanical trouble detector, generation of one-shot pulse is inhibited, so that the time interval of energization of the head is shortened.

1 Claim, 3 Drawing Sheets

PRINT HEAD DRIVE SYSTEM WITH TROUBLE DETECTOR

BACKGROUND OF THE INVENTION

1. Field of the Invention

This invention relates to a head drive system wherein a head is protected by differentiating a time interval of energization thereof between a normal operating time and an abnormal operating time.

2. Description of the Prior Art

According to conventional techniques, the circuit configuration for effecting energization of a head is like that shown in FIG. 1(*a*), wherein response to a pulse signal given from a CPU 1 a one-shot generating circuit 2 is started to generate a one-shot pulse by which a head 3 is energized only during the time interval corresponding to the duration thereof. The timing of the foregoing operation is as shown in FIG. 2(*a*), in which during the ON time of data ①, on the basis of a pulse ② a signal ③ is generated by the one-shot generating circuit 2, and within the time interval corresponding to the pulse duration, the energization of the head 3 is effected (④). Thus, even if trouble occurs at moment $t_1$ and is detected by a mechanical trouble detector 4, the time interval of energization of the head does not differ between the normal operating time and the abnormal operating time.

Further, according to the prior art, the energization of the head is sometimes effected undesirably when the CPU runs uncontrollably (FIG. 4(*b*)).

The conventional system operates in such a manner as is illustrated in the timing chart of FIG. 2(*a*), and still after mechanical trouble is detected (at moment $t_1$) during the energization of the head, the head can be energized. That is, the time interval of energization is identical between the normal operating time and the abnormal operating time.

Further, when the CPU runs uncontrollably, individual pulses given from the CPU create ONs and OFFs at random, and the energization of the head continues beyond the timing of each pulse; thus, an undesirable current flows through the head(see ④ in FIG. 4(*b*)).

SUMMARY OF THE INVENTION

It is an object of the present invention to protect a head by shortening the time interval of energization of a head in an abnormal operating time.

To achieve the foregoing object, according to the present invention, referring to FIG. 1, when a mechanical trouble detector 4 detects trouble, the duration of a pulse given from a one-shot generating circuit 2 is made shorter than the conventional pulse duration in accordance with such a control flow as shown in FIG. 3, so that the time interval of head energization is differentiated between the normal operating time and the abnormal operating time, thereby the head is protected.

Specifically, according to the present invention, in the normal operating time, in accordance with the flow of FIG. 3, a pulse signal ② is generated a few times (the solid line in ② of FIG. 2(*b*)) from a CPU 1 of FIG. 1(*b*), and one-shot pulses of a pulse duration shorter than the energization time interval of the head are generated successively from the one-shot generating circuit, thereby resulting in the total pulse duration (see the solid line in ④ of FIG. 2(*b*)) corresponding to the energization time interval. Then, the above is ANDed with a pulse signal ③ shown in FIG. 1(*b*) to generate a pulse signal ⑤ (the solid line in ⑤ of FIG. 2(*b*)) for causing energization of the head.

In the abnormal operating time (assuming that a trouble occurred at moment $t_1$ in FIG. 2(*b*)), by means of the mechanical trouble detector 4 and in accordance with the flow of FIG. 3, the control of CPU 1 is returned without generating a further one-shot pulse. Accordingly, the second pulse of the signal ② cannot be generated after moment $t_1$ in FIG. 2(*b*), one-shot pulse ④ is made shorter (dashed line) than the conventional one, and the pulse signal ⑤ for energization of the head is also made shorter (dashed line); thus, an undesirable current does not continue to flow through the head.

BRIEF DESCRIPTION OF THE DRAWINGS

FIG. 2(*b*) is a timing chart according to the present invention;

FIG. 4(*b*) is a timing chart in the prior art, corresponding to FIG. 4(*a*).

DESCRIPTION OF THE PREFERRED EMBODIMENT

Figure 1A:
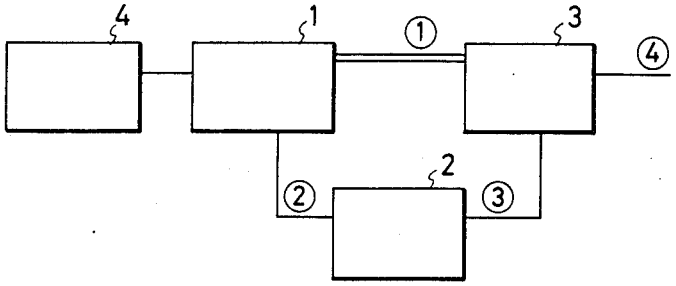
FIG. 1(a) PRIOR ART
FIGS. 1*a* and 1*b* are circuit diagram showing the configurations of the present invention and of the prior art.
Figure 1B:
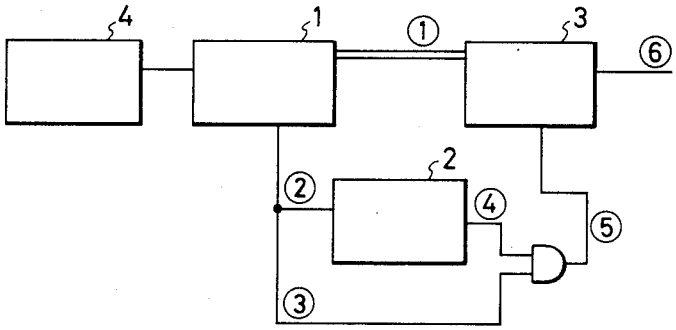

The present invention uses such a circuit configuration as shown in FIG. 1(*b*) and incorporates as the one-shot generating circuit 2 a similar one for generating one-shot pulses of a pulse duration shorter than that of the conventional circuit. In the normal operating time, to obtain a similar timing chart for head-energization to that of the prior art, referring to the flowchart of FIG. 3, the CPU 1 generates the pulse ② a few times during the energization time interval, and the pulses ④ are successively generated from the one-shot generating circuit 2 during the energization time interval (see the solid line in ④ of FIG. 2(*b*)).

Figure 2A:
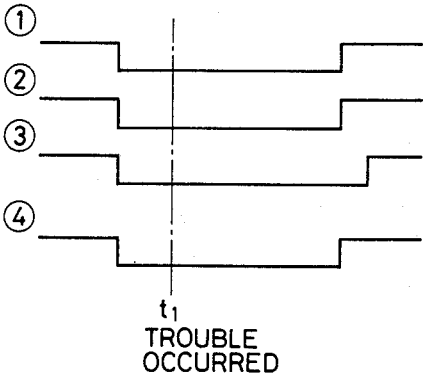
FIG. 2(a) PRIOR ART
FIG. 2(*a*) is a timing chart in the prior art.
Figure 2B:
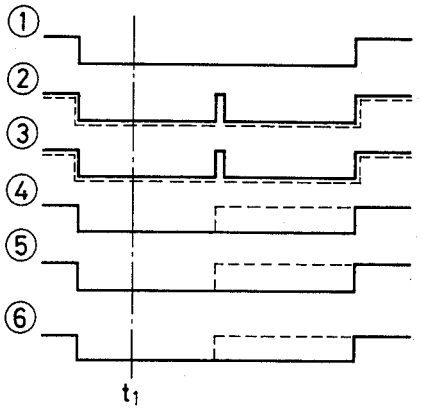

By ANDing the above with the pulse signal ③, the pulse signal ⑤ (see the solid line in ⑤ of FIG. 2(*b*)) is obtained and the head is energized thereby.

Figure 3:
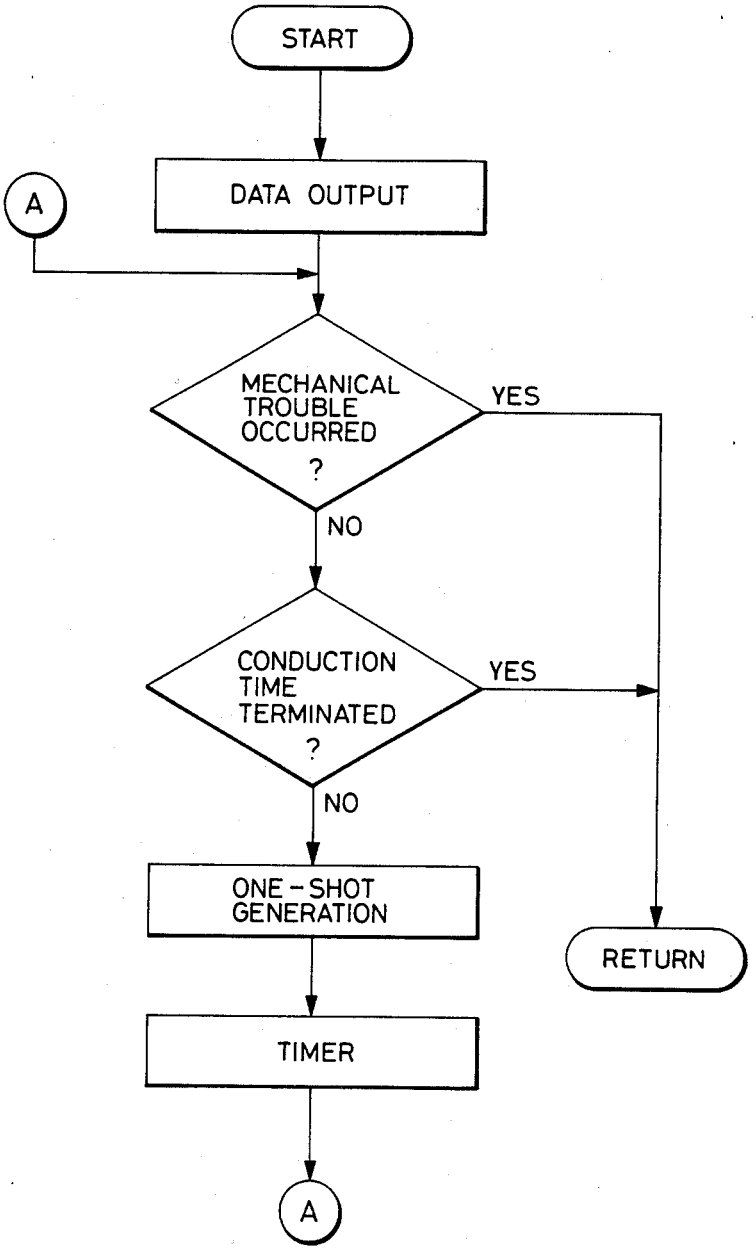
FIG. 3 is a flowchart of an embodiment of the present invention for realizing the timing shown in FIG. 2(*b*) by the use of the present invention configuration shown in FIG. 1.

When abnormal operation has occurred (at moment $t_1$), by the mechanical trouble detector 4 a signal is applied to the CPU 1, and in accordance with the control flow of FIG. 3, "return" is executed without generating thereafter any further pulses of the pulse signal ② for generation of one-shot pulses ④. As a result, after moment $t_1$ the pulse signals ② and ③ illustrated in FIG. 2(*b*) are not generated, whereby the one-shot pulse ④ can be made shorter than that of the normal operating time. Consequently, the pulse signal ⑤ becomes short because of ANDing between the signals ④ and ③, and the energization of the head is inhibited.

Figure 4A:
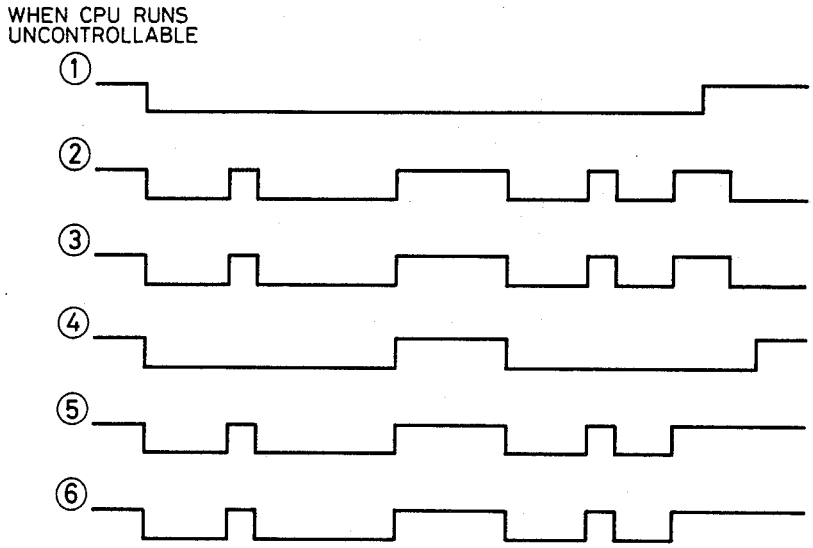
FIG. 4(*a*) is a timing chart according to the present invention when a CPU runs uncontrollably.
Figure 4B:
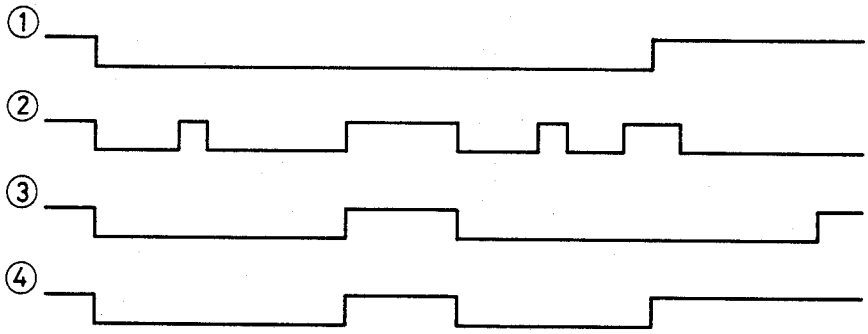
FIG. 4(b) PRIOR ART

FIG. 4 is a timing chart for explanation of the state when the CPU runs uncontrollably. Individual pulses given from the CPU at the time the CPU is running uncontrollably create ONs and OFFs at random (see FIG. 4(*b*), for example). Against the above, according to the present invention, the duration of one-shot pulses is made short; thus, the individual pulses which do not coincide in timing with the random signals will not result in an output pulse, so that the possibility of the head being energized decreases (see FIG. 4(*a*)), compared with the conventional system.

Therefore, the possibility that the head be subjected to energization when the CPU runs uncontrollably lessens.

As described hereinabove, according to the present invention, undesirable energization of the head at the time of occurrence of mechanical trouble is prevented from being effected, and the possiblity of the head being energized undesirably when the CPU runs uncontrollably is reduced, compared with the conventional system.

What is claimed is:

1. In a print head drive system of the type having a CPU for providing an output pulse signal during a head energization interval, a one-shot generating circuit receiving the output pulse signal of the CPU for generating a head energization pulse signal which is supplied as a drive signal to a print head for energization thereof during the head energization interval, and a mechanical trouble detector for providing a trouble signal to the CPU upon detection of mechanical trouble in the print head drive system, wherein the improvement comprises:

said CPU providing pulse in its output pulse signal of shorter duration than said head energization interval, and terminating its output pulse signal when a trouble signal is provided from said mechanical trouble detector; and an AND circuit which is connected to receive the output pulse signal from said CPU and the head energization pulse signal from said one-shot generating circuit, ANDs said pulse signals together, and provides the ANDed output therefrom as the drive signal to the print head, whereby upon occurrence of a trouble signal during the head energization interval, the CPU output pulse signal can be terminated, and the resulting drive signal from said AND circuit can be made shorter in duration than the normal head energization interval.

* * * * *